United States Patent [19]

Francis

[11] Patent Number: 4,865,370

[45] Date of Patent: Sep. 12, 1989

[54] KEEPER FOR DEADBOLT LOCKS

[75] Inventor: Charles E. Francis, Claremore, Okla.

[73] Assignee: John D. Gassett, Tulsa, Okla.

[21] Appl. No.: 197,444

[22] Filed: May 23, 1988

Related U.S. Application Data

[63] Continuation-in-part of Ser. No. 944,933, Dec. 22, 1986, which is a continuation-in-part of Ser. No. 800,696, Nov. 22, 1985, abandoned.

[51] Int. Cl.[4] ..... E05C 21/02

[52] U.S. Cl. ..... 292/340; 292/346; 70/416

[58] Field of Search ..... 292/340, 341, 346; 70/416, 418

[56] References Cited

U.S. PATENT DOCUMENTS

| | | | |
|---|---|---|---|
| 2,019,263 | 10/1935 | Kemp | 70/14 |
| 2,255,860 | 9/1941 | Riedel | 292/340 |
| 2,370,781 | 3/1945 | Cullum | 292/346 |
| 2,639,177 | 5/1953 | Smith | 292/169 |
| 3,095,021 | 6/1963 | Schlage et al. | 292/340 X |
| 3,426,418 | 2/1969 | Maloney | 29/407 |
| 4,057,275 | 11/1977 | La Beaud | 292/340 |
| 4,159,838 | 7/1979 | Wilzig et al. | 292/150 |
| 4,174,862 | 11/1979 | Shane | 292/346 |
| 4,186,954 | 2/1980 | Detlefs | 292/340 |
| 4,195,870 | 4/1980 | Percoco | 292/340 |
| 4,211,442 | 7/1980 | Hansen | 292/340 |
| 4,474,394 | 10/1984 | Crepinsek | 292/340 |
| 4,550,939 | 11/1985 | Babb, Jr. et al. | 292/340 |

*Primary Examiner*—Carl D. Friedman

*Attorney, Agent, or Firm*—Head & Johnson

[57] ABSTRACT

A strengthening device for use with a deadbolt lock and includes a planar metal anchor plate having a hole with an anchor pocket welded to the plate at the hole. The anchor plate is installed between the door jamb and the framing or door stud. The anchor pocket extends into the hole in the door jamb through which the deadbolt is insertible. When the deadbolt is installed in the door, the bolt will extend into the anchor plate. In another embodiment, a metal bolt guide is inserted from the outer side of the door jamb into the anchor pocket.

8 Claims, 4 Drawing Sheets

KEEPER FOR DEADBOLT LOCKS

This application is a continuation-in-part of my application Ser. No. 944,933 filed Dec. 22, 1986 which is a continuation-in-part of my application Ser. No. 800,696 filed Nov. 22, 1985.

BACKGROUND OF THE INVENTION

This invention relates to door security devices and more particularly to a device for having a strengthened bolt guide for a deadbolt lock.

Deadbolt locks are used more and more to help make one's home secure. The deadbolt lock proper is mounted in the door and can be turned with a key to extend upwardly to one inch or more from the edge of the door. This deadbolt is extendible into a bolt receiving recess in the door jamb. Normally, a strike plate is mounted over the recess or hole in the door jamb. With this system, the lock itself is hard to tamper with or to unlock for that matter. However, in most cases, the weak spot is the door jamb itself into which the anchor hole has been drilled. A quick force applied to the door in the vicinity of the deadbolt lock has frequently been known to split the jamb asunder and to cause the door to be readily opened. There have been numerous attempts to strengthen the bolt anchoring recess.

It is an object of the present invention to provide a novel and improved securing device for strengthening the deadbolt locking system.

SUMMARY OF THE INVENTION

This is a mechanism for strengthening a locking system featuring a deadbolt lock. In a preferred embodiment it includes a planar anchor plate without any lip along any edge which is placed next to the interface of a door jamb and the trimmer stud. The anchor plate is preferably secured by long screws extending through the jamb into the trimmer stud. The anchor plate has an anchor pocket welded thereto and which is preferably shaped somewhat like a rectangular tubular member. This anchor pocket extends from the anchor plate side of the jamb into the hole of the jamb into which the deadbolt will be extended. In another embodiment, a bolt guide which is only slightly smaller on the outside than the inside of the anchor pocket is inserted from the door side of the door jamb into the anchor pocket. Thus, the bolt guide, into which the deadbolt is insertible, is secured through the anchor pocket to the anchor plate which is supported by a large portion of the door jamb. Thus, the bolt guide is held in an extremely secure position.

In another embodiment, the anchor plate is "L" shaped and is divided into a large side and a small side with the large side being attached preferably by screws to the inside of the door jamb and the smaller side can be attached to trim.

Forces which induce splitting of the door jamb during an attempted forceable entry is transmitted over a large part of the door jamb and not just at the deadbolt recess or hole. Further, the anchor plate also strengthens the door jamb, thus giving a very strong structural combination which can resist a rather strong splitting force caused by an attempted forcible entry.

DETAILED DESCRIPTION OF THE PREFERRED EMBODIMENT

Figure 1:
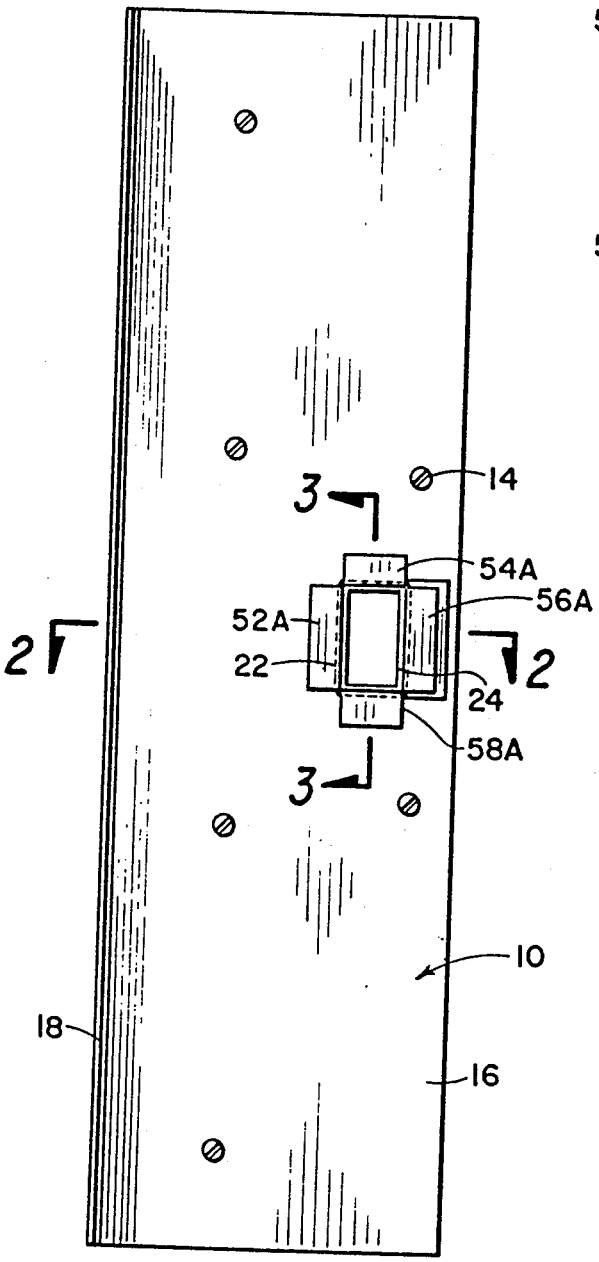
FIG. 1 illustrates a full face view of an anchor plate with anchor pocket installed.
Figure 2:
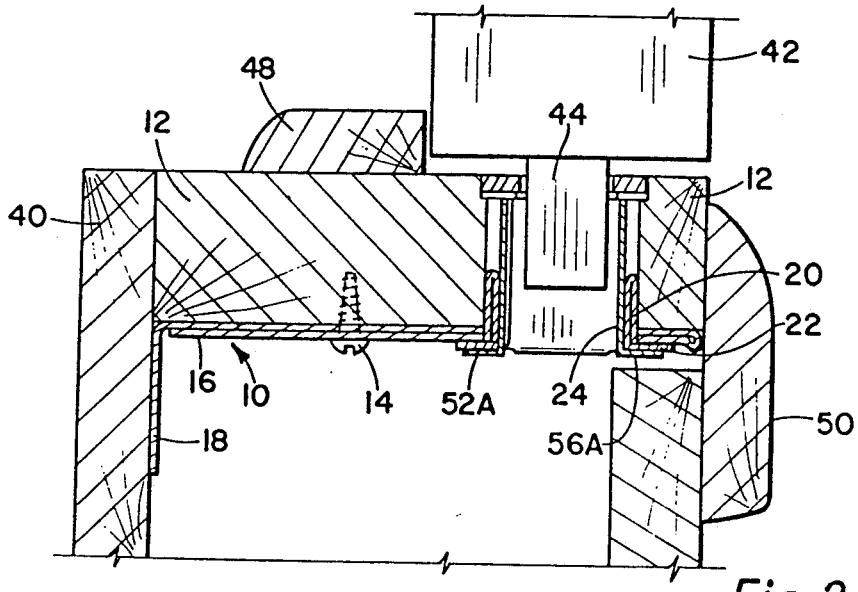
FIG. 2 is a view taken along the line 2—2 of FIG. 1.

Attention is first directed to FIG. 1 which shows an anchor plate 10 having been mounted on door jamb 12 as shown in FIG. 2 by a plurality of anchor bolts or screws 14. In one embodiment, the anchor plate 10 is comprised of a first planar section 16 and a second planar section 18 which are connected together to be "L" shaped as shown in FIG. 2. Using only the planar section 16 greatly enforces the door jamb.

My anchor plate 10 is also provided with an anchor pocket 20 having tabs 22 which are secured such as by welding to anchor plate 10. In this embodiment a bolt guide 24 fits into anchor pocket 20. This can be seen more clearly in FIGS. 2 and 3. In this embodiment, anchor pocket 20 is preferably a tubelike rectangular shaped member which is integral with anchor pocket tabs 22 which is secured such as by welding to the anchor plate 10. The anchor pocket may be modified so that there is only one side of the pocket used instead of all four sides that make up the tube like anchor pocket. If this modification is made, then that side which is used must be rather strong.

Figure 3:
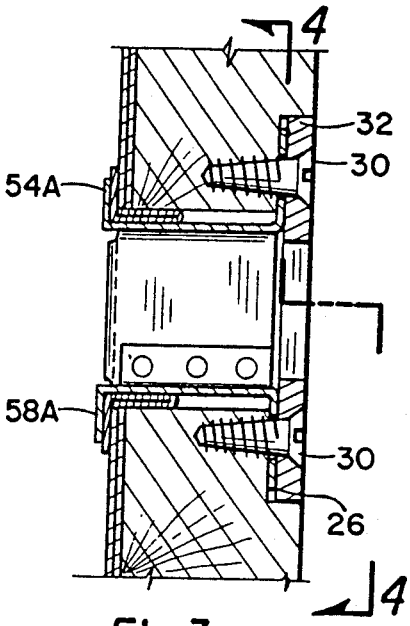
FIG. 3 is a view taken along the line 3—3 of FIG. 1.
Figure 5:
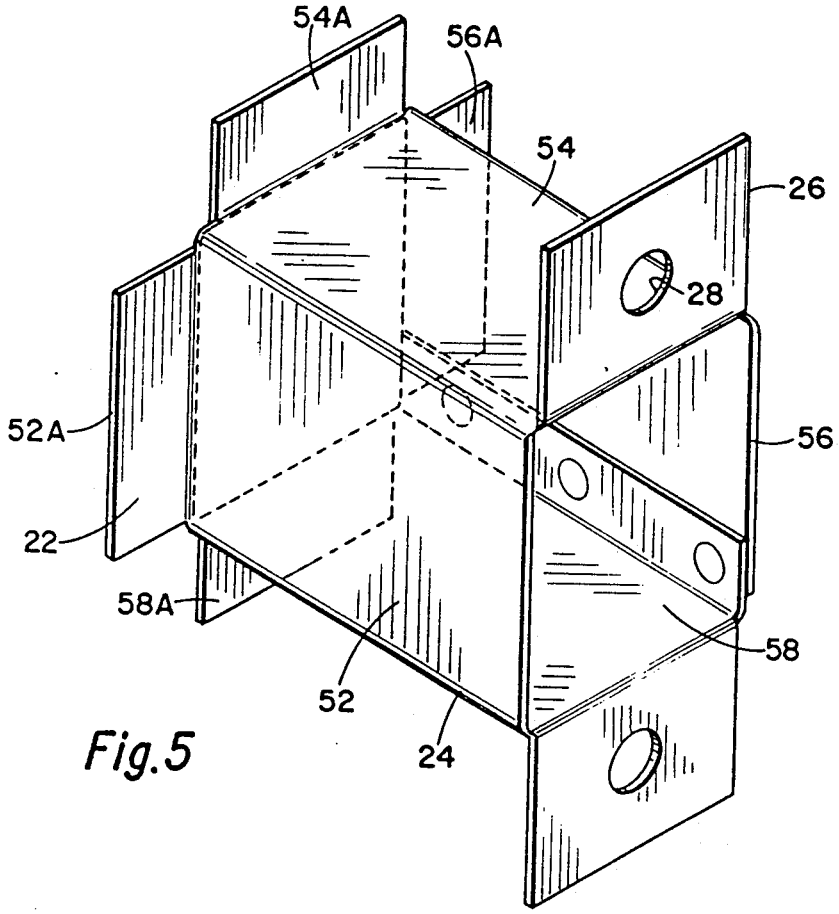
FIG. 5 illustrates a bolt guide.

The bolt guide 24 is shaped similar to the anchor pocket 20 but its outside dimension is only slightly smaller than the inside dimension of the anchor pocket 20 so that it can be inserted snugly into the anchor pocket. As shown clearly in FIG. 5, the bolt guide 24 is provided with tabs 26 having holes 28 therein to which bolts or screws 30 may be inserted as shown in FIG. 3. The bolt guide 24 is a hollow tube-like member having sides 52, 54 56 and 58. Each of these sides have extensions or tabs 52A, 54A, 56A and 58A which, before insertion into the anchor, are in the same plane as the respective side. After the bolt guide 24 is inserted in the anchor pocket 20, the tabs 52A, 54A, 56A and 58A are bent to the shape shown in FIG. 5 and are flush with the inside of Sheet 16 as shown in FIGS. 2 AND 3.

Figure 4:
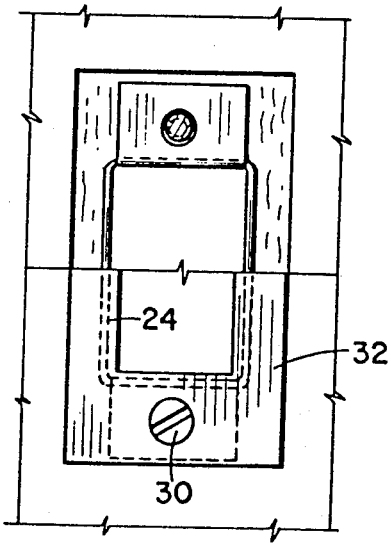
FIG. 4 is a view taken along the line 4—4 of FIG. 3.

To briefly summarize, it is seen that in this embodiment I have an anchor plate 10 which is secured by screws 14 to the inner side of the door jamb. The plate means 10 is provided with an anchor pocket 20 which is secured to the anchor plate. The anchor plate is mounted on the door jamb such that the anchor pocket 20 extends into the recess or hole in the door jamb for receiving the deadbolt. Once the anchor pocket is inserted and the anchor plate is secured to the door jamb, the bolt guide 24 is then inserted into the anchor pocket 20. The strike plate 32 shown in FIG. 4 is placed over the tabs 26 and holes align with holes 28. Then, screws 30 secure the keeper 32 to the door jamb through tabs 26.

As shown in FIGS. 2 and 3, the anchor plate planar section 16 can be made of two layers of heavy gauge steel to give it additional strength. The anchor plate may be made of 28 gauge galvanized metal, for example. The "L" portion 16 can be double-layered if desired, however, normally section 18 will not be. Section 18 can be secured to trim 40 in any conventional manner.

As also shown in FIG. 2, a door 42 is provided with a bolt 44 of a deadbolt lock which is insertable within bolt guide 24. The door 42 is adjacent the door stop 48. An inside trim 50 is also indicated.

The anchor pocket should extend far enough to be efficient in holding the bolt guide. It is believed that the anchor pocket should be at least ⅝" or more in depth, that is extending perpendicular from the face of plate 16 inasmuch as most deadbolts are only 1" long. It is thus clear that the anchor pocket is essential inasmuch as frequently the dead bolt is not long enough to extend through a hole in plate 16.

Figure 6:
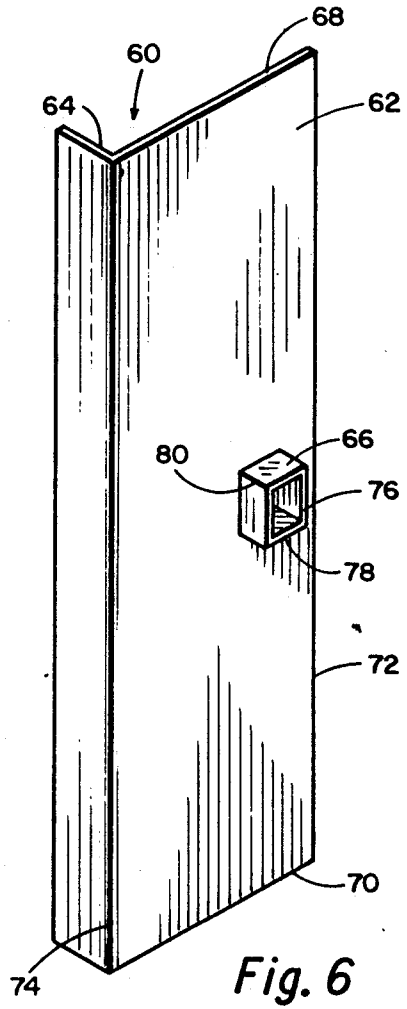
FIG. 6 is a perspective view of one form of anchor plate

Attention is next directed to FIG. 6 which shows another embodiment of the anchor plate. Shown thereon is a main plate 62 and an anchor shoulder or lip 64 which is essentially at a right angle to the main plate 62. A bolt pocket 66 is secured, such as by welding, to the face of main plate 62 preferably at about midway between the top 68 and the bottom 70. It will normally be nearer edge 72 of the main plate 62 than the corner 74. Bolt pocket 66 must extend into a hole in the door jamb a sufficient distance to receive the deadbolt. To my knowledge, no prior art shows a bolt pocket welded directly an anchor plate. A conventional strike assembly would not transmit force to the anchor plate. Typically the width of the main plate 62 between edge 72 and corner 74 is about 4½ inches and the height between the top 60 and the bottom 70 is about 15½ inches. The width of anchor shoulder 64 is typically about 1¼ inches. The pocket 66 is of a size to readily receive the deadbolt for which it will be used with. Typically the height on side 76 is approximately one inch and the width on side 78 is approximately ¾ inches, and the depth or dimension along edge 80 is about ⅝ inches.

Figure 7:
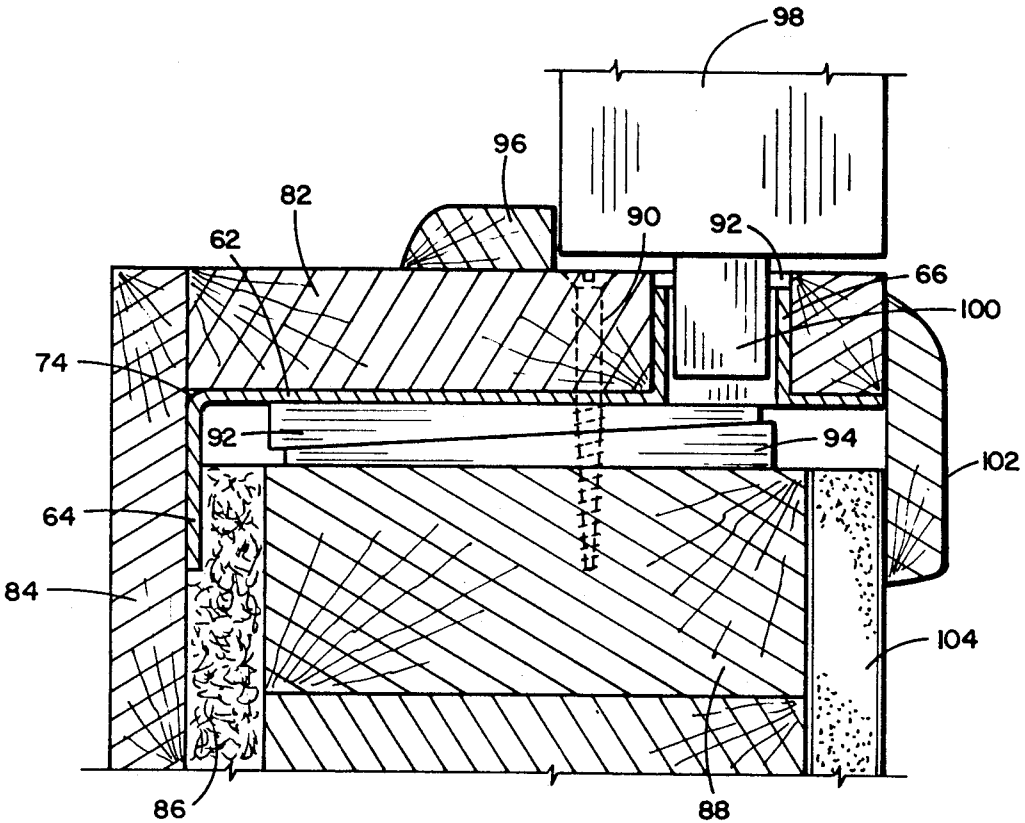
FIG. 7 is a sectional view similar to FIG. 2 showing the installation of the anchor plate of FIG. 6.

Attention is next directed to FIG. 7 which shows the anchor plate of FIG. 6 installed. Shown thereon is the main plate installed adjacent the jamb 82 and the anchor shoulder 64 installed adjacent the board trim 84. An insulation board 86 is positioned between the trim 84 and stud 88 which is typically a piece of two inches by four inches wood. The anchor plate 60 is held in position by one or more screws 90 which extends through the jamb 82, the main plate 62 and into the stud 88. The pocket 66 extends into hole 92 which is cut in the jamb 82. Shims 92 and 94 are used to properly position the main plate 62 against the jamb 82 as illustrated in FIG. 7.

Also shown in FIG. 7 is a door stop 96 for door 98 which has bolt 100 which extends into pocket 66. The inside dimensions of pocket 66 is so sized with respect to bolt 100 so that there is the proper clearance. Also shown in FIG. 7 is the inside trim 102 and sheetrock 104. Also if desired anchor shoulder or lip 64 may be secured to trim 84 by any conventional means such as by screws. Anchor shoulder 64 is thus held against insulation board 86 which is adjacent stud 88 so that any inwardly force against door 98 which would tend to move it away from doorstop 96 would be further resisted by the stud 88.

Figure 8:
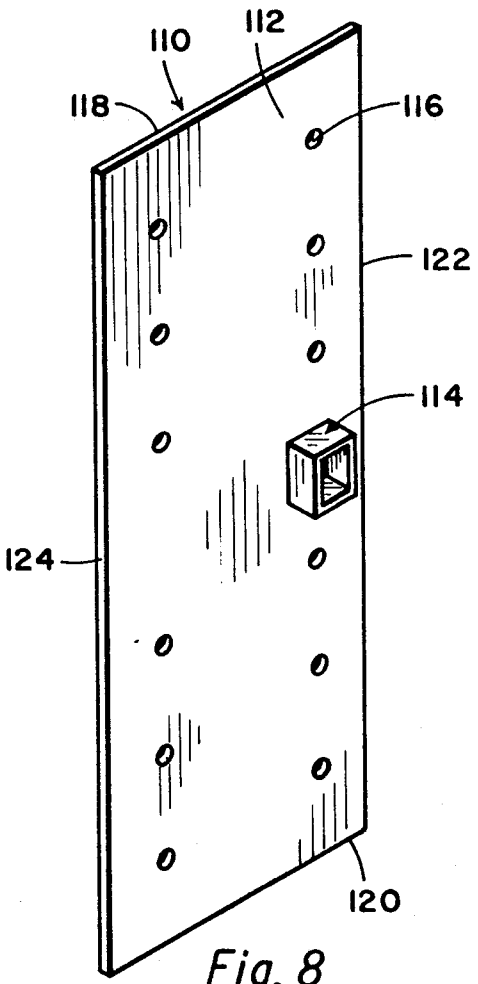
FIG. 8 is a perspective view of the preferred form of anchor plate.
Figure 9:
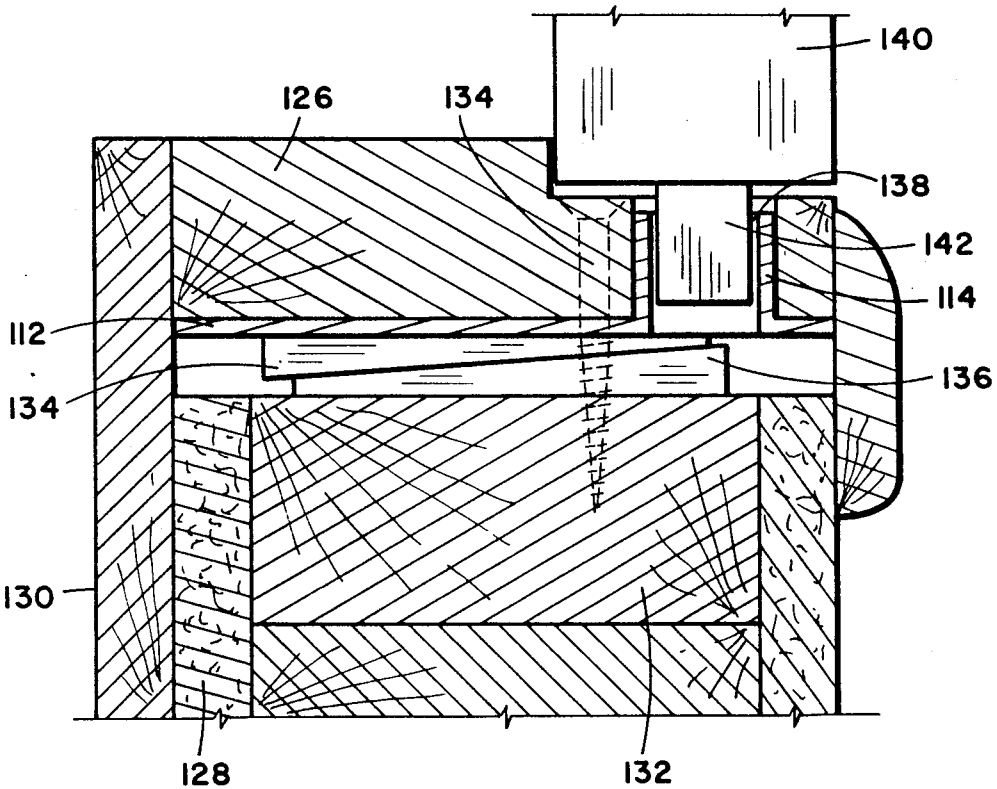
FIG. 9 is a sectional view showing the installation of the anchor plate of FIG. 8.

Attention is now directed to FIG. 8 which shows the preferred embodiment of the anchor plate. There is shown the preferred anchor plate 110 which has a planar plate 112 with bolt or anchor pocket 114. Screw receiving holes 116 are provided. Bolt pocket 114 is fixed to planar plate 114 such as by welding. As can be seen the bolt pocket 114 is fixed directly to the plate 112 without any intermediate elements. It is preferred that it be welded thereto. Preferably, the anchor pocket 114 is at about the midway between the top 118 and the bottom 120 of the plate It will normally be nearer edge 122 than edge 124 so that as shown in FIG. 9 it can readily receive the locking bolt. The anchor pocket 114 must be anchored securely to plate 112 so that force can be transmitted directly to the anchor plate from the pocket, if force is applied thereto through the bolt. Typically, the width of plate 112 is slightly less than about 4½ inches and the height between the top 118 and the bottom 120 is typically about 12 inches. Other heights and widths may be used. The depth of the anchor pocket 114 is typically about ¾ inches which may be typically about the size as that given above in regard to the bolt pocket 66 of FIG. 6.

Attention is next directed to FIG. 9 which shows the anchor plate of FIG. 8 installed. Shown thereon is a planar plate 112 installed adjacent the inner or concealed face of door jamb 126. An adhesive may be applied to the surface of anchor plate 112 which is adjacent jamb 126 to hold it in place. An insulation board 128 is positioned between the trim 130 and stud 132 which is typically a piece of wood 2" by 4". Positioning shims 134 and 136 are normally used to properly position the plate 112 and jamb 126 in relation to the door opening as illustrated in FIG. 9. When installed, the jamb 126 and anchor plate 112 are preferably held in position by one or more screws 134 which extends through the jamb 126, the plate 112, the shims 134 and 136 if any are used, and into the stud 132. This arrangement of the anchor plate greatly strenghens the jamb 126 and by securing it to the door stud 132 adds greater stability to the overall security system. As can be seen in FIG. 9 a hole 138 has been bored or otherwise made through jamb 126 and it is into this hole 138 that anchor pocket 114 extends. Door 140 is provided with a locking bolt 142 such as that of a deadbolt lock which when extended extends into the anchor pocket 114. The inside dimensions of pocket 114 is such as to readily receive bolt 142 in a relatively snug position but still be sufficiently large so that the bolt can readily enter therein. The anchor plate in installation shown in FIGS. 8 and 9 is preferred over that of FIGS. 6 and 7. Inasmuch as the plate 112 is planar, there needs to be no grooving to make room for an L-shaped lip. The anchoring plate of FIG. 8 is much easier to install than plates having lips.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A mechanism for strengthening a locking system having a bolt which extends into a recess in a door jamb of an installed door frame and having a concealed side opposite the part of the jamb adjacent the door when closed and having a stud which consists of:

an anchor plate planar in structure and without any upturned edge;

an anchor pocket member having a first end open and a second end, said second end welded to said anchor plate, said anchor pocket member extendible into said recess for receiving said bolt through said open end, said anchor pocket being small compared to said plate and positioned interior of the edges thereof.

2. A mechanism for strengthening a locking system featuring a bolt which extends into a recess in a door jamb which comprises:

an anchor plate;

an anchor pocket member fixed to said anchor plate;

a bolt guide insertable within said anchor pocket, said bolt guide being provided with tabs at one end extending perpendicularly therefrom and each tab having a hole therethrough and further in which said bolt guide is rectangularly shaped and has tabs at the other end thereof which may be bent at right angles with respect to the sides of the bolt guide.

3. A mechanism for strengthening a locking system featuring a bolt which extends into a recess in a door jamb in an installed door frame having a concealed side opposite the part of the jamb adjacent the door when closed which comprises:

an anchor plate;

an anchor pocket member fixed to said anchor plate;

a bolt guide insertable within said anchor pocket;

said bolt guides being provided with tabs at one end extending perpendicularly therefrom and each tab having a hole therethrough and in which said bolt guide is rectangularly shaped and has tabs at the other end thereof which may be bent at right angles to the respective sides of the bolt guide.

4. A mechanism for strengthening a locking system featuring a door having a deadbolt lock having an extendible bolt which is extendible into a recess in a door jamb in a door frame, said jamb having a concealable side which comprises:

a strengthening plate made up of not over two planar sheets and having a hole therein;

an anchor pocket comprising at least one plate-like projection secured to said plate around said hole and extending a selected distance in a direction approximately perpendicular to said anchor plate;

a bolt guide insertable within said anchor pocket a distance equal to about said selected distance and in which the bolt guide is rectangularly shaped and has tabs at the insertable end which may be bent at right angles to the respective sides of the bolt guide.

5. A mechanism for strengthening a locking system featuring a bolt which is extendible which comprises:

a door jamb of an installed door having a recess and a concealed side opposite the part of the jamb adjacent the door when closed;

a door stud on the concealed side of the jamb;

an anchor plate planar in structure having edges and without any upturned portion along any edge and secured to said concealed side of said jamb and secured only in one plane;

an anchor pocket member secured only to said anchor plate at a position interior of said edges and extending into said recess for receiving said bolt, said anchor pocket being small compared to said plate;

at least one screw extending through said door jamb, said plate and into said stud;

a strike plate secured to said jamb on the side thereof opposite the concealed side and having a hole positioned about the hole of said recess in said jamb.

6. A method of increasing the security of a door mounted to a jamb in a wall opening which has a wall stud which comprises the steps of:

obtaining a deadbolt anchoring plate having a planar member and an anchor pocket welded thereto;

cutting a hole in said jamb of a size to receive said anchor pocket, said hole is interior of the edges of said any edge of said jamb;

inserting said anchor pocket through said hole in the back side of said jamb;

securing the planar member to the back side of said jamb to strengthen said jamb;

securing said planar member to said stud at least by extending a screw through said jamb, said planar member and into said stud;

said planar member being secured only in one plane.

7. A mechanism for strengthening a locking system featuring a bolt which extends into a recess in a door jamb of an installed door frame having a concealed side opposite the part of the jamb adjacent the door when closed and also having a stud which comprises:

an anchor plate having a face and an X and Y dimension and edges and being completely planar in structure and having no upturned edge;

an anchor cup member rectangularly shaped in cross section in a plane parallel to said plate, the cross-section has a first and a second dimension neither of which is over about twenty-five percent of the smaller of the X and Y dimensions rigidly fixed directly to and in direct contact with the face of said anchor plate and said cup member being completely interior of any edge of said anchor plate, said anchor cup member is tubular with two ends, one end fixed to said anchor plate and the other end away from the anchor plate is open.

8. A mechanism as defined in claim 7 in which the thickness of the walls of said cup member is small compared to said first and second dimension.

* * * * *